US006775929B2

(12) United States Patent
Katz et al.

(10) Patent No.: US 6,775,929 B2
(45) Date of Patent: Aug. 17, 2004

(54) ATHLETIC SHOE OR SNEAKER WITH STABILIZATION DEVICE

(75) Inventors: Barry H. Katz, 3 Gateshead Dr., Bridgewater, NJ (US) 08807; Thomas Nordstrom, Bridgewater, NJ (US); Steven Dribben, Flemington, NJ (US)

(73) Assignee: Barry H. Katz, Bridgewater, NJ (US)

( * ) Notice: Subject to any disclaimer, the term of this patent is extended or adjusted under 35 U.S.C. 154(b) by 107 days.

(21) Appl. No.: 10/037,395

(22) Filed: Jan. 3, 2002

(65) Prior Publication Data

US 2002/0088144 A1 Jul. 11, 2002

Related U.S. Application Data

(60) Provisional application No. 60/300,913, filed on Jun. 26, 2001, and provisional application No. 60/260,570, filed on Jan. 9, 2001.

(51) Int. Cl.[7] ..... A43B 7/14; A43B 7/20; A43B 23/28; A43B 5/00; A43B 5/04

(52) U.S. Cl. ..... 36/88; 36/89; 36/114; 36/58.5; 36/117.9

(58) Field of Search ..... 36/88, 91, 89, 36/90, 114, 58.5, 143, 144, 136, 117.6, 117.9, 25 R

(56) References Cited

U.S. PATENT DOCUMENTS

| | | | | |
|---|---|---|---|---|
| 1,545,623 A | | 7/1925 | Westfall | |
| 2,096,677 A | | 2/1937 | Fassett | |
| 2,179,942 A | | 11/1939 | Lyne | |
| 2,531,763 A | | 11/1950 | Andre | |
| 3,327,410 A | | 6/1967 | Park, Sr. | |
| 3,613,273 A | | 10/1971 | Marquis | |
| 4,335,529 A | | 6/1982 | Badalamenti | |
| 4,411,077 A | | 10/1983 | Slavitt | |
| 4,476,639 A | * | 10/1984 | Zaccaria | 36/114 |
| 4,577,419 A | | 3/1986 | Chassaing | |
| 4,621,648 A | | 11/1986 | Ivany | |
| 4,641,438 A | * | 2/1987 | Laird et al. | 36/32 R |
| 4,748,753 A | | 6/1988 | Ju | |
| 4,865,023 A | | 9/1989 | Craythorne et al. | |
| 4,866,861 A | * | 9/1989 | Noone | 36/134 |
| 4,922,630 A | | 5/1990 | Robinson | |
| 5,269,078 A | * | 12/1993 | Cochrane | 36/88 |

(List continued on next page.)

FOREIGN PATENT DOCUMENTS

| | | | | |
|---|---|---|---|---|
| WO | WO 91/11124 | * | 8/1991 | A43B/13/00 |

OTHER PUBLICATIONS

Stephen H. Liu et al., "Lateral Ankle Sprains and Instability Problems", *Clinics in Sports Medicine*, vol. 13, No. 4, Oct. 1994, pp. 793–809.

(List continued on next page.)

*Primary Examiner*—Anthony D. Stashick
(74) *Attorney, Agent, or Firm*—Frishauf, Holtz, Goodman & Chick, P.C.

(57) ABSTRACT

A stabilization device for an athletic shoe or sneaker having two elongate straps for wrapping around a foot within the shoe. The straps are attached to the inside sidewalls of the shoe and exit the shoe through lateral slits adjacent to the sole. Each strap then passes through a buckle, and the two straps are attached to each other with a VELCRO material. Two lateral support bumpers, integral with the shoe near the sole and which project outwardly on the lateral sidewall, provides further projection against foot injuries. The upper shoe component having a sufficiently stiff consistency to prevent acute angles that form during inversion stresses.

23 Claims, 8 Drawing Sheets

U.S. PATENT DOCUMENTS

| | | | | | |
|---|---|---|---|---|---|
| 5,449,005 | A | | 9/1995 | Echols | |
| 5,678,330 | A | | 10/1997 | Van Dyke et al. | |
| 5,771,608 | A | | 6/1998 | Peterson | |
| 5,819,439 | A | | 10/1998 | Sanchez | |
| 5,875,569 | A | * | 3/1999 | Dupree | 36/103 |
| 5,893,221 | A | | 4/1999 | Weissman et al. | |
| 5,957,871 | A | | 9/1999 | Darcey | |
| 5,992,057 | A | | 11/1999 | Monti | |
| 6,018,889 | A | * | 2/2000 | Friton | 36/28 |
| 6,050,002 | A | | 4/2000 | Meschan | |
| 6,108,943 | A | * | 8/2000 | Hudson et al. | 36/114 |
| 6,266,897 | B1 | * | 7/2001 | Seydel et al. | 36/29 |
| 6,474,006 | B1 | * | 11/2002 | Cummings et al. | 36/25 R |
| 6,505,424 | B2 | * | 1/2003 | Oorei et al. | 36/89 |

OTHER PUBLICATIONS

Stephen B. Thacker et al., "The Prevention of Ankle Sprains in Sports", *The American Journal of Sports Medicine*, vol. 27, No. 6, (1999), pp. 753–760.

James R. Barrett et al., "High–Versus Low–Top Shoes for the Prevention of Ankle Sprains in Basketball Players", *The American Journal of Sports Medicine*, vol. 21, No. 4, (1993), pp. 582–585.

Robert A. Ottaviani et al., "Basketball Shoe Height and the Maximal Muscular Resistance to Applied Ankle Inversion and Eversion Moments", *The American Journal of Sports Medicine*, vol. 23, No. 4, (1995), pp. 418–423.

Edward P. McDermott, "Basketball Injuries of the Foot and Ankle", *Clinics in Sports Medicine*, vol. 12, No. 2, (Apr. 1993), pp. 373–393.

Kenneth A. Johnson et al., "Sprained Ankles as They Relate to the Basketball Player", *Clinical in Sports Medicine*, vol. 12, No. 2, Apr. 1993. pp. 363–371.

Michael Sitler et al., "The Efficacy of a Semirigid Ankle Stabilizer to Reduce Acute Ankle Injuries in Basketball", *The American Journal of Sports Medicine*, vol. 22, No. 4, (1994), pp. 454–461.

K. Quinn et al., "Interventions for Preventing Ankle Ligment Injuries", *Cochrane Database Syst. Rev.,* (2000), vol. 2:CD000018 abstract only.

O. Petrov et al., "Footwear and Ankle Stability in the Basketball Player", *Clin. Podiatr. Med. Surg.,* (Apr. 5, 1988), vol. 2, pp. 275–290 abstract only.

C. Milgrom et al., "Risk Factors for Lateral Ankle Sprain: A Prospective Study Among Military Recruits", *Foot Ankle*, (Aug. 12, 1991), No. 1, pp. 26–30 abstract only.

D.F. Messina et al., "The Incidence of Injury in Texas High School Baketball. A Prospective Study Among Male and Female Athletes", *Am. J. Sports Med.*, (May–Jun. 27, 1999), vol. 3, pp. 294–299 abstract only.

J. Leaderson et al., "Ankle Injuries in Basketball Players", *Knee Surg. Sports Traumatol Arthrosc*, (1993), vol. 1, Nos. 3–4, pp. 200–202 abstract only.

* cited by examiner

FIG 1
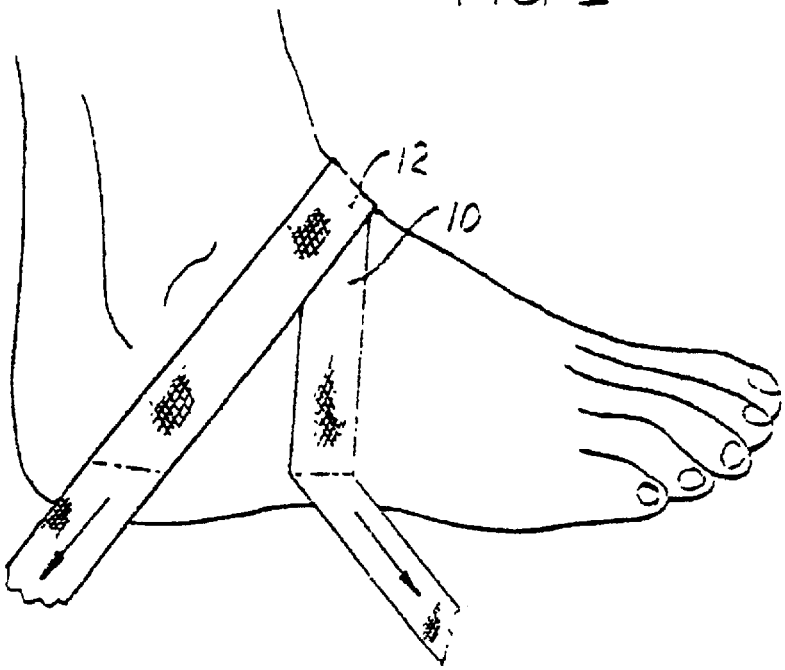
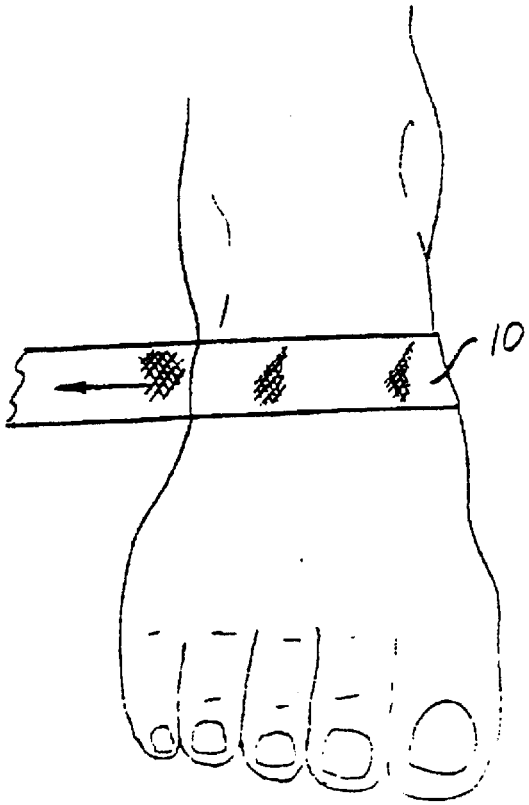
FIG 2

ATHLETIC SHOE OR SNEAKER WITH STABILIZATION DEVICE

CROSS REFERENCE TO RELATED APPLICATIONS

The present application claims the benefit of Provisional Application Serial No. 60/260,570, filed Jan. 9, 2001 and Provisional Application Serial No. 60/300,913, filed Jun. 26, 2001, wherein priority under 35 USC 119(e) is claimed.

BACKGROUND OF THE INVENTION

1. Field of the Invention

The present invention concerns a stabilization device for an athletic shoe such as a sneaker. More particularly, the present invention is directed to an intrinsic stabilization device and also an extrinsic safety support for an athletic shoe to effectively prevent ankle sprains.

2. Background Information

The modern athletic shoe, especially shoes for basketball, has become quite stylish. However, there is a very high incidence of ankle sprains in both competitive and recreational athletes ("Lateral Ankle Sprains and Instability Problems", Liu, Stephen H., Jason, William J., *Clinics in Sports Medicine*, Vol. 13, No. 4, October 1994). The modern athletic shoe, particularly for basketball, may actually contribute to the high incidence of lateral ankle sprains. There have been many previous attempts at improving the safety of the athletic shoe, mostly increasing the height of the shoe ("Basketball Shoe Height and the Maximal Muscular Resistance to Applied Ankle Inversion and Eversion Moments", Ottaviani, Robert A., Ashton-Miller, James A., Kothari, Sandip U. and Wojtys, Edward M., *The American Journal of Sports Medicine*, Vol. 23, No. 4, 1995; "High- Versus Low-Top Shoes For the Prevention of Ankle Sprains in Basketball Players; A Prospective Randomized Study", Barrett, James R., Tanji, Jeffrey L, Drake, Christian et al., *The American Journal of Sports Medicine*, Vol. 21, No. 4, 1993). Since this did not significantly reduce the incidence of lateral ankle sprains, many extrinsic devices have been used and developed in conjunction with the high-top shoe. These extrinsic devices include tape, braces, orthotics and elastic wraps ("The Prevention of Ankle Sprains in Sports; A Systematic Review of the Literature", Thacker, Stephen B., Stroup, Donna F., Branche, Christine M. et al., *The American Journal of Sports Medicine*, Vol. 27, No. 6, 1999; "The Efficacy of a Semirigid Ankle Stabilizer to Reduce Acute Ankle Injuries in Basketball, A Randomized Clinical Study of West Point", Sitler, Michael, Ryan, Jack, Wheeler, Bruce et al., *The American Journal of Sports Medicine*, Vol. 22, No. 4, 1994; "Interventions for Preventing Ankle Ligament Injuries", Quinn, K., Parker, P., de Bie, R. et al., *Cochrane Database Syst. Rev.* 2000; (2): CD000018). Each of these extrinsic devices has specific problems.

Lateral ankle sprain is the most common injury in basketball players and one of the most common overall sports injuries seen in medical emergency rooms. While this injury is most common for basketball players, this injury often occurs in other sports which involve jumping, and running with sharp cuts. These sports include soccer, football, volleyball, cross-country running, tennis, track, and baseball ("The Prevention of Ankle Sprains in Sports; A Systematic Review of the Literature", Thacker, Stephen B., Stroup, Donna F., Branche, Christine M. et al., *The American Journal of Sports Medicine*, Vol. 27, No. 6, 1999).

The most common mechanism of injury in basketball is a player jumping up and landing on an uneven surface, often another player's foot ("Lateral Ankle Sprains and Instability Problems", Liu, Stephen H., Jason, William J., *Clinics in Sports Medicine*, Vol. 13, No. 4, October 1994; "Sprained Ankles as They Relate to the Basketball Player", Johnson, Kenneth A., Teasdall, Robert D., *Clinics in Sports Medicine*, Vol. 12, No. 2, April 1993; "Basketball Injuries of the Foot and Ankle", McDermott, Edward P., *Clinics in Sports Medicine*, Vol. 12, No. 2, 1993; "Physics of an Inversion Ankle Sprain", McIntyre, Kelli, Internet site http://members.aol.com/SRobson 32/kelly.html). The foot is generally in plantar flexion and inverted. When the vertically loaded lateral forces exceed the everting muscles of the lower leg, the lateral ligaments tear. The anterior talofibular ligament is the most commonly injured ligament, followed by the calcaneofibular ligament and the posterior talofibular ligament. In the other sports described above, similar vertical loading also can occur. Another mechanism is excessive force applied to the medial ankle, such as a baseball player sliding into another player's ankle or a soccer player "slide tackling" another to steal the ball.

While athletic shoes have become increasingly stylish, they have not been able to reduce the incidence of lateral ankle sprains. In fact, the nature of the design of shoes with a hard sole with firm medial and lateral edges in conjunction with a soft upper portion actually contributes to and exacerbates the problems of lateral instability, as described above. When an ankle inverts in plantar flexion, and especially when a vertical load is applied when landing from a jump, the point of landing is on the hard lateral edge of the sports shoe. The relatively softer upper portion of the shoe connected to the hard lower sole bends on an acute angle. This causes apposition of the medial part of the shoe with the medial ankle and a wide gap that forms between the soft upper shoe and the lateral ankle. It is this "disconnect" that develops between the shoe and the lateral ankle that leads to a lack of support. The forces are entirely placed on the lateral ligaments (described above) which subsequently tear, as they cannot support the full weight of the body landing on them as may happen in the various sports activities discussed above.

The above explanation accounts for the fact that high-top shoes do no better than low-top shoes in preventing lateral ankle sprains. The current design of sports shoes, especially basketball shoes, do not adequately protect the lateral ligaments. To illustrate this point, if one stands on the lateral edges of modern basketball shoes, then allows one's ankle to invert gently, one can feel the stresses laterally. This is under controlled conditions without movement, or vertical loading. On the other hand, lateral injuries rarely occur in shoeless athletes that jump (i.e., beach volleyball). If one jumps in place and intentionally inverts the ankle while shoeless, no particular lateral stress is appreciated.

Ankle injuries during skiing have almost totally disappeared with the development of the uniformly firm and stiff ankle boots used in modern skiing. When a foot in a ski boot inverts, the ankle and the boot are in unison, totally connected, and this does not allow the boot and the ankle to form the large lateral gaps needed to stress the lateral ligaments. Unfortunately, in skiing, the stresses have moved up to the knee joint, where injuries are now quite common. However, the stiffness of a ski boot would not be practical in any of the other sports discussed herein.

As discussed above, current solutions to attempt to avoid ankle sprains in athletes consist of externally applied tape, braces and orthotics. However, each of these have significant problems associated with them. External taping has been the traditional method used to prevent capsuloligamentous injuries of the ankle. There is mixed data to the efficacy of taping in preventing ankle sprains. It is well known that tape loosens with physical activity, with a 50% reduction in initial support after 10 minutes of exercise and with little if any support after 30 minutes ("The Prevention of Ankle Sprains in Sports; A Systematic Review of the Literature", Thacker, Stephen B., Stroup, Donna F., Branche, Christine M. et al., *The American Journal of Sports Medicine*, Vol. 27, No. 6, 1999; "The Efficacy of a Semirigid Ankle Stabilizer to Reduce Acute Ankle Injuries in Basketball, A Randomized Clinical Study of West Point", Sitler, Michael, Ryan, Jack, Wheeler, Bruce et al., *The American Journal of Sports Medicine*, Vol. 22, No. 4, 1994). While the strength of the tape may initially be able to prevent the "lateral gap" formed with forced inversion, the ability of the tape to do so later during the activity is markedly diminished. Since the tape is extrinsic to both the ankle and the shoe, the disconnect described above exists with taping. Secondly, tape is expensive and the cost is additive over the course of an entire sports season. Thirdly, properly applied tape is initially quite tight and often uncomfortable. Fourthly, tape is also irritating to the skin. Finally, tape must be applied by trained athletic personnel.

Lace-up ankle stabilizers were found to be more effective than taping in preventing ankle sprains. As long as they do not loosen, the effect of these theoretically counteracts the lateral gap that forms with injuries. The ankle will not invert significantly. These devices are inherently uncomfortable, cumbersome and time consuming to apply. In a study done in 1994, initially half of participants wearing the brace had a negative attitude about wearing it, which remained at 30% at the conclusion of the study ("The Efficacy of a Semirigid Ankle Stabilizer to Reduce Acute Ankle Injuries in Basketball, A Randomized Clinical Study at West Point", Sitler, Michael, Ryan, Jack, Wheeler, Bruce et. al., *The American Journal of Sports Medicine*, Vol. 22, No. 4, 1994). The stabilizers were viewed as uncomfortable and had a perceived negative effect on performance.

Inflatable cuffs to high top shoes were not shown to statistically significantly decrease the occurrence of sprains ("High- Versus Low-Top Shoes For the Prevention of Ankle Sprains in Basketball Players; A Prospective Randomized Study", Barrett, James, R., Tanji, Jeffrey, L., Drake, Christian et al., *The American Journal of Sports Medicine*, Vol. 21, No. 4, 1993).

Unfortunately, all of the above devices are generally employed after an athlete has suffered ligamentous injury, in order to prevent subsequent sprains. The damage has already been done. Ankle functionality has been diminished below baseline levels.

Park, Sr., et al. U.S. Pat. No. 3,327,410 concern an athletic shoe with an integral flexible ankle support. The athletic shoe of U.S. Pat. No. 3,327,410 has two straps that wrap around the ankle high up and do not extend across the lateral ligaments. This is cumbersome to apply. The outside wrap puts direct pressure on the Achilles tendon and would cause irritation.

Slavitt U.S. Pat. No. 4,411,077 is directed to an athletic shoe with an attached ankle brace.

Craythorne et al. U.S. Pat. No. 4,865,023 relate to a hard brace ankle support shoe. This rigid support may not allow for full functionality of the ankle and could be uncomfortable to wear. This is not an intrinsic device inherently.

Van Dyke et al. U.S. Pat. No. 5,678,330 describe a shoe with an integral, rigid brace ankle support.

Sanchez U.S. Pat. No. 5,819,439 involves a shoe for a bodybuilder which allows for the performance of thigh exercises. The design of the straps do not specifically address the issue of lateral ligament stability.

Peterson U.S. Pat. No. 5,771,608 describes a shoe with an ankle strap protection. The straps do not anatomically support the lateral ligament complex. Peterson emphasizes eversion injuries, which are rare in basketball players. In addition, biofeedback mechanisms for an athlete airborne to prevent inversion or eversion injuries would be difficult to occur because of the short time within the air and also fails to account for injuries occurring when an athlete lands on someone else's foot. Lateral bumper supports are also not present.

Monti U.S. Pat. No. 5,992,057 concerns a strapping and closure system for an outer heel strap and instep piece, rather than a fixed ankle support system. This is in a cleated shoe.

Badalamenti U.S. Pat. No. 4,335,529 provides a traction device for shoes for lateral traction for soccer or football cleated shoes. The Badalamenti design is not adequate to prevent inversion ankle injuries, nor is it meant to do so.

Chassaing U.S. Pat. No. 4,577,419 concerns a high-top shoe with only an outer strap. This does not adequately join the ankle and shoe as a single unit.

Lyne U.S. Pat. No. 2,179,942 describes a golf shoe with attachments projecting off the medial shoe to prevent excessive movement or rotation of the left foot during the golf backswing. This has no bearing on safety to the lateral ligaments. The Lyne shoes have spikes, rather than provide a hard rubber athletic shoe.

Ivany U.S. Pat. No. 4,621,648 disclose an ankle support system having an inner brace combined with outer straps. This design is cumbersome and difficult to apply.

Marquis U.S. Pat. No. 3,613,273 and Robinson U.S. Pat. No. 4,922,630 describe shoes which include external straps.

Shoes for specific sports are disclosed in Westfall U.S. Pat. No. 1,545,623 (hockey boot); Fassett U.S. Pat. No. 2,096,677 (skate shoe); Andre U.S. Pat. No. 2,531,763 (ski boot); and Ju U.S. Pat. No. 4,747,753 (golf shoe).

Echols U.S. Pat. No. 5,449,005 describe a removable, shoe interior ankle brace.

Weissman et al. U.S. Pat. No. 5,893,221 relate to footwear having a protuberance which extends medially outwardly from the mid region of the shoe.

Darcey U.S. Pat. No. 5,957,871 concerns a custom-fitted ankle splint product.

Meschan U.S. Pat. No. 6,050,002 relates to an athletic shoe having a flexible member disposed between a foot support region and above the sole.

SUMMARY OF THE INVENTION

It is an object of the present invention to prevent or reduce ankle inversion stresses that could lead to ankle injuries during athletic activities of athletes wearing athletic shoes or sneakers.

It is another object of the present invention to provide an athletic shoe or sneaker that can be easily applied and universally available to all athletes.

In one aspect of the present invention, an enhanced athletic shoe has an intrinsic stabilizer device, which will not allow the "disconnection of ankle and shoe" during inversion stresses. This will diminish the "lateral gap" that is formed between ankle and shoe during inversion, and exacerbated by the heretofore design of sports shoes. The intrinsic stabilizer device will allow for a full range motion in the ankle joint, preserving functionality. The athletic shoe according to the present invention will be comfortable, easily applied, fully functional and significantly safer than heretofore models.

In this embodiment of the present invention, two straps are employed. The first strap is unique in that it directly adjoins the ankle to the shoe as a single unit. It can be cinched to secure quite easily, yet remain a stylish addition to the outside of the shoe. It can also be recinched easily during the activity if it should become loosened. The second strap is unique in its location within the wall of the shoe, its anatomic relationship to the lateral ligaments, its lack of irritation to the Achilles tendon as it does not directly contact this structure, the ability to easily apply and cinch this strap tightly, to recinch, if necessary, if it loosens during the activity, and its relatively stylish appearance on the top of the shoe.

In another aspect of the present invention, laterally placed stabilizer devices attached to the outside of the shoe will further prevent injury by resisting and countering the force of the initial inversion. This embodiment of the present invention involves lateral bumper supports that are unique in their location and design and act as insurance back-up, should inversion occur. The aim of the lateral bumper supports is to reduce or prevent forced inversion of the ankle during athletic activities and thus reduce both the frequency and severity of lateral ankle sprains in athletes.

In a further aspect of the present invention, the medial and lateral sides of the athletic shoe according to the present invention will be made stiffer than heretofore to prevent the acute angles that form during inversion stresses. The significant differences between the stiffness of the sole from the upper shoe will therefore be slightly diminished. This third embodiment of the present invention serves to make the shoe upper of a slightly stiffer material (such as a leather) or to add an elastic polymer to diminish the acute bending of the upper with the sole during inversion injuries.

The present invention concerns an athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, a back portion between the medial sidewall and the lateral sidewall; and two elongate straps, one end of each of the two elongate straps being intimately secured to an inner surface of the shoe, the two elongate straps supporting the ankle mortise and lateral ligaments of a foot within the shoe, the two elongate straps each having a free end which is detachably securable to each other on an outer surface of the shoe and tightenable to reduce or prevent ankle inversion stresses of a foot within the shoe.

The present invention is further directed to an athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, a back portion between the medial sidewall and the lateral sidewall;

a first elongate strap secured at an end portion thereof at a junction of the sole and the medial sidewall, the first elongate strap extending inside the shoe across the upper surface of the sole in a region where the mid arch of a foot within the shoe would be located, and extending horizontally for disposition on the top of a foot within the shoe, the first elongate strap exiting the shoe through the lateral sidewall adjacent to the upper surface of the sole for extending across a top surface of the shoe and passing through a first fastening device disposed on an outer surface of the shoe and adjacent to the top of the medial sidewall, the first elongate strap having a first attachment component on a free end thereof; and a second elongate strap secured at an end portion thereof at the lateral sidewall of the shoe in a region where the level of the base of the $5^{th}$ metatarsal of a foot within the shoe would be located, the second elongate strap extending across the back portion of the shoe adjacent to the top of the upper component, and running parallel to the sole in the medial sidewall before exiting the medial sidewall, and extending horizontally within a tongue in an upper surface of the upper component, the second elongate strap extending across the ankle of a foot within the shoe, the second elongate strap exiting the shoe through the lateral sidewall adjacent to the upper surface of the sole and passing through a second fastening device disposed posterior to the first fastening device, the second elongate strap having a second attachment component on a free end thereof for engagement with the first attachment component of the first elongate strap.

The present invention also concerns an athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, a back portion between the medial sidewall and the lateral sidewall;

a first elongate strap secured at an end portion thereof at a junction of the sole and the medial sidewall, the first elongate strap extending inside the shoe across the upper surface of the sole in a region where the mid arch of a foot within the shoe would be located, and extending horizontally for disposition on the top of a foot within the shoe, the first elongate strap exiting the shoe through a first slit in the lateral sidewall (reinforced with an internal D-ring) adjacent to the upper surface of the sole for extending across a top surface of the shoe, passing through a first fastening device, such as a buckle (external D-ring), on an outer surface of the shoe and adjacent to the top of the medial sidewall, the first elongate strap having a first releasable attachment component being disposed on an inner surface thereof and adjacent to a free end of the first elongate strap; and a second elongate strap secured within a channel in the lateral sidewall of the shoe in a region where the level of the base of the $5^{th}$ metatarsal of a foot within the shoe would be located, the second elongate strap extending across the back portion of the shoe adjacent to the top of the upper component, and running parallel to the sole in the medial sidewall before exiting the medial sidewall, and extending horizontally within a channel within a tongue in an upper surface of the upper component, the second elongate strap extending across an ankle of a foot within the shoe and exiting the shoe through a second slit (also reinforced with an internal D-ring) on the lateral sidewall adjacent to the upper surface of the sole, the second elongate strap passing through a second fastening device, such as a buckle (external D-ring), disposed posterior to the first fastening device, the second elongate strap having a second releasable attachment component on an inner surface of a free end thereof for engagement with the first releasable attachment component of the first elongate strap.

The present invention further relates to an athletic shoe comprising:

a bottom component having a top surface and a bottom surface, the bottom component including a sole having an upper surface and a lower surface;

an upper component extending from the top surface of the bottom component for accommodating a foot, the upper component having a medial sidewall, a lateral sidewall and a back portion between the medial sidewall and the lateral sidewall; and at least two lateral support bumpers disposed integrally with the shoe and on an outer surface of the lateral sidewall, the lateral support bumpers being disposed adjacent to the sole above the bottom surface of the bottom component, and the lateral support bumpers being positioned on the shoe and of sufficient dimensions to reduce or prevent ankle inversion stresses of a foot within the shoe. Preferably one of the lateral bumpers is disposed in a region where the head of the $5^{th}$ metatarsal of a foot within the shoe would be located, and a second of the lateral support bumpers is disposed adjacent to the anterior heel, the lateral support bumpers preferably each having a base portion which projects laterally outward from the shoe at a distance of approximately ⅜ to ⅝ inches.

The present invention is also directed to an athletic shoe comprising:

a bottom component having a to surface and a bottom surface, the bottom component including a sole, an upper component extending from the top surface of the bottom component for accommodating a foot, the upper component having a medial sidewall and a lateral sidewall and a back portion between the medial sidewall and the lateral sidewall;

at least one of the medial sidewall and the lateral sidewall having a sufficiently stiff consistency (for example, made of leather or by addition of an elastic polymer) to reduce or prevent acute angles that form during inversion stresses to a foot within the shoe. Preferably both the medial sidewall and the lateral sidewall have the aforesaid sufficiently stiff consistency.

BRIEF DESCRIPTION OF THE DRAWINGS

For the purposes of illustrating the invention, there is shown in the drawings forms which are presently preferred. It is to be understood, however, that the present invention is not limited to the precise arrangements and instrumentalities depicted in the drawings.

FIG. 1 is a perspective view showing a foot and ankle without a sock and without the shoe, but which shows how the straps of the shoe would wrap around the foot and the ankle.

FIG. 2 is a perspective view which shows the front of a right foot without a sock and without the shoe, but which shows how one of the straps of the shoe would wrap around the foot.

DETAILED DESCRIPTION OF THE INVENTION

Figure 3:
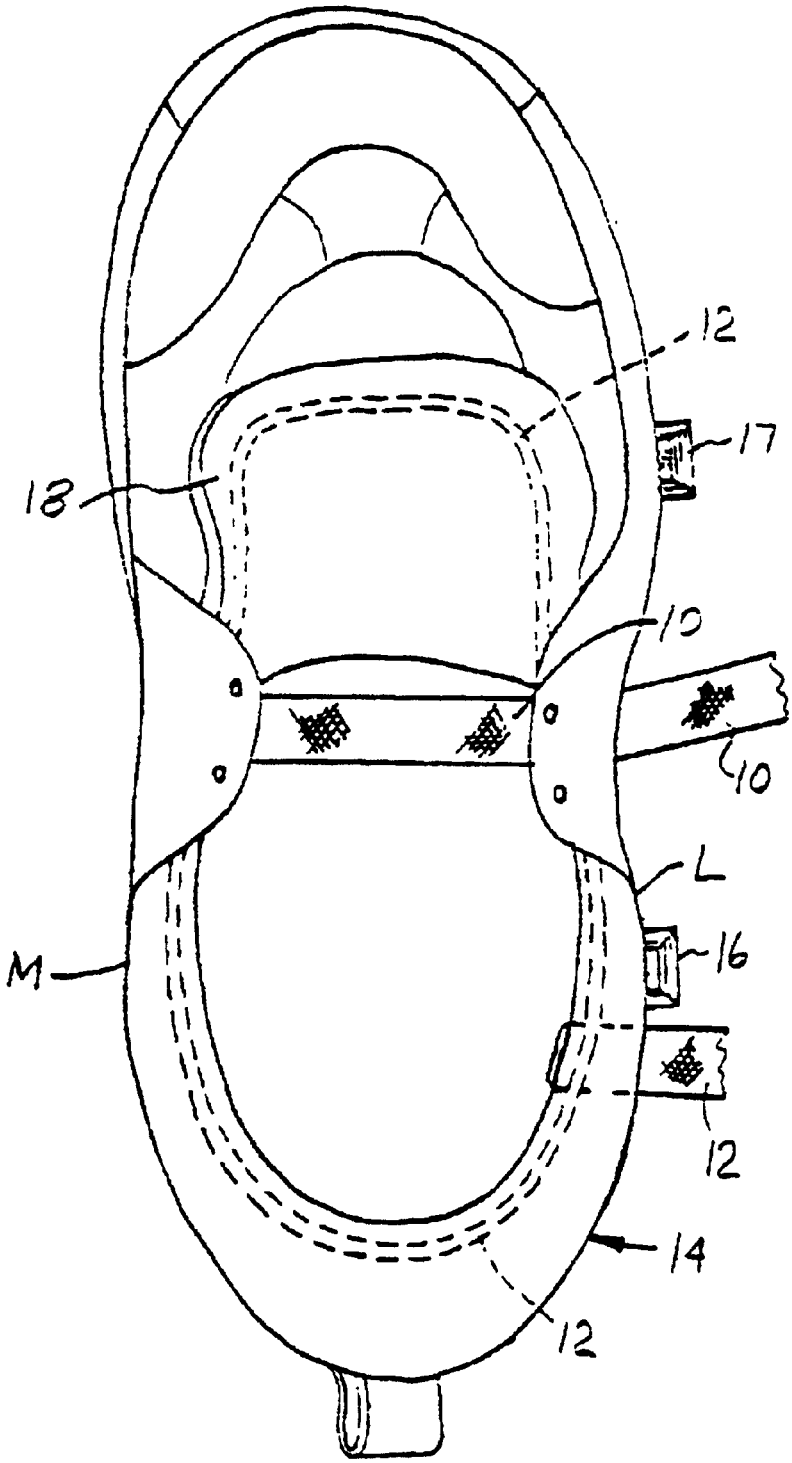
FIG. 3 is a plan view of an athletic shoe (right shoe) according to an embodiment of the present invention depicting the inner support straps with the "tongue" of the shoe opened up and pulled forward.

The present invention provides an athletic shoe which serves to stabilize the lateral ankle in a neutral position of a person wearing the athletic shoe. It has been shown that keeping the ankle at 0 degrees of plantar flexion in conjunction with three quarter top basketball shoes has increased the maximal resistance to an inversion stress by 29.4% ("Basketball Shoe Height and the Maximal Muscular Resistance to Applied Ankle Inversion and Eversion Moments", Ottaviani, Robert A., Ashton-Miller, James A., Kothari, Sandip U., and Wojtys, Edward M., *The American Journal of Sports Medicine*, Vol. 23, No. 4, 1995).

In addition, the present invention serves to "reconnect" the shoe and ankle, not allowing the dangerous "lateral gap" to form as it does with the modern athletic shoes during injury.

The athletic shoe of the present invention will have a "back-up support" to lessen the stress of ankle inversion.

No extrinsic devices to the athletic shoe of the present invention are necessary, allowing for enhanced comfort for the wearer of the shoe, such as an athlete, diminished cost and improved safety (even when compared to the heretofore employed external devices as described herein). Full functionality of the athletic shoe will be present and style can be maintained as before.

The hallmark of one embodiment of the present invention is the built-in application of an intrinsic stabilization device, which in essence substitutes for the heretofore extrinsically applied tape, but does not have the disadvantages of tape as described above. The material for such device should be strong and durable.

Three embodiments of the present invention are further discussed as follows.

Internal Fixation Straps

The configuration of the internal fixation straps will be discussed first. This is made up of two components, i.e., two straps. A first strap is made preferably of a strong, firm material, including but not limited to "NYLON", with good tensile strength and with little fatigueability. The first strap will preferably measure approximately 1⅜ to 1⅝ inches wide and preferably ½ inches in width.

The first strap is attached to the inside of the shoe, such as by sewing or riveting or both at the junction of the medial wall of the athletic shoe, with the sole at the level of the mid arch medially. The first strap extends horizontally over the top surface of the sole and over the sole insert. The person places his/her foot into the athletic shoe and places the first strap over the foot horizontally across the top of the ankle mortise. The first strap then comes out of the lateral sidewall of the athletic shoe through a slit (such as a lateral slit) which is disposed in the athletic shoe just above the sole, for example, a hard rubber sole.

The first strap is directly perpendicular to both the medial and lateral sidewalls of the athletic shoe. At this point, the person laces up the athletic shoe in the usual manner. The person then pulls and cinches up the strap to a moderate degree of tension.

The first strap should be firmly placed over the ankle and sock of the wearer of the athletic shoe, but should remain comfortable to the wearer of the athletic shoe. After the first strap exits the athletic shoe and the cinching is completed, the first strap wraps over the tongue of the athletic shoe, approximately over the third lace holes and is placed through a D-ring buckle that is secured to the outside medial sidewall of the athletic shoe, approximately 1 inch below the top of the medial sidewall of the athletic shoe.

Both sides of the first strap contain a releasable attachment or fastening device such as a hook and pile type fastening material of the type commonly known as a "VELCRO" fastener (complementary male and female forms which adhere to one another when pressed together and are separated by being pulled apart) after they exit the lateral athletic shoe. After extending through the fixed buckle, the first strap is again pulled firmly and fixed to itself over the tongue. The first strap should extend approximately 9 to 11 inches beyond the lateral slit to account for different size athletic shoes.

The purpose of the first strap is to intimately fix the foot to the athletic shoe to eliminate the "disconnect" that occurs during forced inversion of the ankle. This in turn will prevent the lateral "gapping" that leads to tears in the lateral ligaments and other injuries. The first strap will cross approximately perpendicular to the anterior talofibular ligament, adding support to this important structure.

The second strap is the second component of the stabilizer device. The second strap is made of a strong, durable material including, but not limited to "NYLON", and which is approximately 1¼ to 1½ inches in width. The second strap originates and is firmly attached to the inside of the athletic shoe, such as by sewing or riveting or both within the lateral sidewall at approximately the level of the base of the $5^{th}$ metatarsal. The second strap is attached, such as being sewn or riveted or both, at the junction of the sole and lateral sidewall of the athletic shoe, or may be attached slightly above such level in the lateral sidewall upper.

The second strap extends through the most superficial portion of the lateral sidewall, through a channel or track that allows the second strap to be pulled or moved within the wall. This is similar to a string in sweat-pants which can be easily moved through an inner track with little friction. The second strap angles up and extends in a posterior and superior direction within this channel.

At the level of the Achilles tendon, the top of the second strap is located approximately ½ inch from the top of the athletic shoe. The second strap continues within this channel and runs parallel to the sole in the medial sidewall of the athletic shoe. The second strap is then visible for perhaps ¼ to ½ of an inch as it exits the medial sidewall. The second strap then enters the medial tongue and extends through the entire tongue of the athletic shoe, also within a loose channel.

The top of the second strap will be approximately 1½ inches below the top of the tongue. The second strap exits the lateral sidewall of the tongue and extends inferiorly and posteriorly across the sock and ankle, just below the lateral malleolus and also exits the athletic shoe in a slit (such as a lateral slit) that is located just above the sole. The slit is located posteriorly to the slit for the first strap.

The second strap is approximately parallel to the calcaneofibular ligament and will also extend across the anterior talofibular ligament, supporting both of these structures.

The second strap is pulled and cinched, following the fixation of the first strap. Both the first strap and the second strap are pulled firmly and should be fairly tight. The second strap extends across the tongue at approximately the level of the first and second laces, extends through a second buckle which is placed just posterior to the buckle for the first strap, is further cinched and ultimately is pulled back over the tongue and is secured on the attachment component, such as a "VELCRO" material, of the first strap. The second strap measures approximately 9 to 11 inches to account for different size athletic shoes. The top side of the second strap will contain an attachment component, such as a "VELCRO" material, so that it can attach to the attachment component, such as a "VELCRO" material, covering the first strap.

When the athletic shoe of the present invention is properly applied (fitted on a foot), the wearer of the shoe, for example, an athlete, will not be able to acutely bend the hard, fixed sole from the relatively softer lateral side of the athletic shoe when inverting, as the ankle, foot, shoe and stabilization device (straps) are all connected as one unit. The stabilization device (straps) should stay taut during the exercise program, but if it inadvertently loosens, it can be easily retightened.

Lateral Bumper Supports

A second embodiment of the present invention comprise lateral bumper supports. There will be preferably two lateral bumper supports, each preferably molded and manufactured into the sole laterally. The lateral bumper supports will preferably be intrinsic components of the sole, rather than be attached to it as an extrinsic device.

The more anterior lateral bumper support will be disposed at the level of the head of the $5^{th}$ metatarsal, and the posterior lateral bumper support will be located at the anterior aspect of the heel, just proximal to the base of the $5^{th}$ metatarsal. The lateral bumper supports will act as a "door-stop" and prevent further inversion of the ankle. These will be most effective when the foot lands awkwardly on the lateral sole on the ground.

The lateral bumper supports will preferably be made of a material having sufficient stiffness to resist a forced ankle inversion, such as a very hard rubber material and preferably will be shaped similar to a right triangle. The hypotenuse of the triangle is the side that projects most laterally. There is a broad based part that lies inferiorly that is the landing area, measuring approximately ⅜ inches to ⅝ inches across and preferably ½ inch across. The base projects outwardly from the shoe for ⅜ inches to ⅝ inches. The medial side of this triangular bumper approximately forms a right angle with the base. The lateral bumper supports preferably will measure approximately ¾ inch in height and extend about ¼ to ⅜ inch above the bottom of the sole and do not contact the ground unless there is significant inversion of the ankle, i.e., the lateral bumper supports do not touch the ground during routine walking, running, jumping or landing. The lateral bumper supports can be made to be decorative with, for example, team colors or insignias on the lateral sides.

It is only in the unlikely event that there is either misapplication of the straps or malfunction, leading to forced inversion of the ankle with "lateral gapping" of the shoe and ankle that the lateral bumper supports will act as a back-up mechanism and prevent ankle sprain. The lateral bumper supports are specifically placed anatomically on the shoe for the following reason. If a plantar-flexed inversion vertical loading injury overrides the straps, the point of impact will probably be anterior/lateral, near the $5^{th}$ metatarsal. This will be the first support. If the foot is in more dorsiflexion or neutral, then the point of stress on the lateral ankle will be more posterior, probably near the lateral sub-talar joint. This will invoke the function of the lateral bumper supports.

Enhancement of Stiffness of Sidewalls

A third embodiment of the present invention provides overall enhancement of the stiffness of the upper component including the lateral and medial sidewalls of the shoe.

The upper component comprising the lateral wall and medial wall of the athletic shoe is thus made from a material having a more similar degree of stiffness as the bottom component (sole), than basketball shoes used heretofore, which should eliminate the acute bending of the shoe during forced inversion of the ankle. This can be done by making the upper component of a slightly stiffer material than heretofore utilized (such as leather) or by adding an elastic polymer compound.

An elastic polymer may be applied to both the medial and lateral aspects of the shoe to enhance the overall stiffness of the shoe. On the medial side, it forms a triangular shape, extending to an apex to the top of the more posterior buckle, extending across the medial upper soft component, and down to approximately the level of the head of the first metatarsal distally, and to the mid heel level proximally. The elastic polymer could also encompass the medial hard lower sole in these areas.

Laterally, the elastic polymer is applied in a similar triangular distribution. It reaches superiorly to approximately ⅔ way up the lateral upper, to the lateral heel sole proximally and to the level of the head of the $5^{th}$ metatarsal and the distal lateral bumper more distally.

The elastic polymer may also encompass the posterior heel lower sole.

Referring to the drawings in detail, wherein like numerals designate like parts, in FIG. 1, strap 10 (which would attach to the shoe medially, and would exit the shoe through a lateral slit) is a firm, durable material, such as "NYLON", which slips over the ankle at the level of the ankle mortise. Strap 12 can be a nylon strap, which crosses the ankle anterior to the lateral malleolus and posterior to strap 10 and would exit the shoe through a second lateral slit.

In FIG. 2, strap 10 is shown extending across the ankle mortise in a perpendicular orientation and extending laterally. Strap 12 is not shown in FIG. 2.

FIG. 3 shows the athletic shoe 14 (right shoe), wherein the medial wall is designated as "M" and the lateral wall is designated a "L", with the tongue 18 opened and pulled forward. Lateral bumper supports 16 and 17 are positioned on the lateral ("L") side of the athletic shoe 14. The lateral bumper supports 16 and 17 are preferably made of rubber. The anterior lateral bumper support 17 is located at the level of the head of the $5^{th}$ metatarsal. The more posterior lateral bumper support 16 is located at the anterior aspect of the heel, just proximal to the base of the $5^{th}$ metatarsal.

The tongue 18 of the athletic shoe 14 is open in FIG. 3 and contains strap 12 within a superficial channel or track, entering the tongue 18 medially and exiting it laterally. Strap 12 exits the lateral shoe 14 through a slit 20 just above the sole. FIG. 3 also shows the course of strap 12 through the lateral, posterior and medial shoe, within the relatively frictionless channel, before it enters the wall of the tongue 18. Strap 12 exits the shoe posterior to strap 10. Strap 10 is also shown extending across the insert of the shoe and exiting laterally, anterior to strap 12. Strap 10 is shown to exit the shoe just above the $2^{nd}$ posterior lateral bumper support 16.

Figure 4:
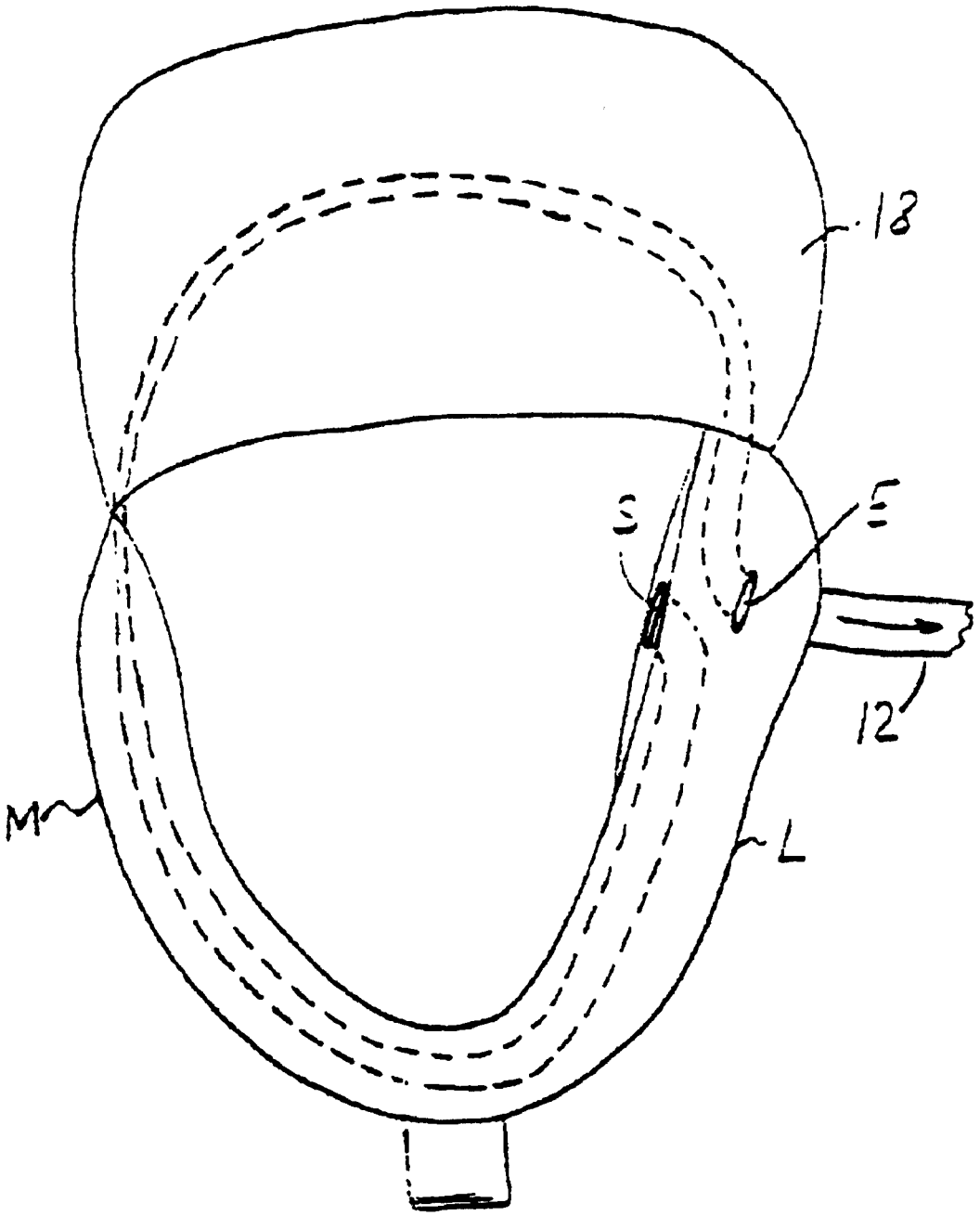
FIG. 4 is a plan view which shows the path of one of the straps of an athletic shoe according to the present invention.

FIG. 4 shows the path of strap 12 within the wall of the athletic shoe 14 with the tongue 18 open and the strap 10 being removed. "S" indicates the start of the path of strap 12 and "E" indicates the exit of the strap 12.

Figure 5:
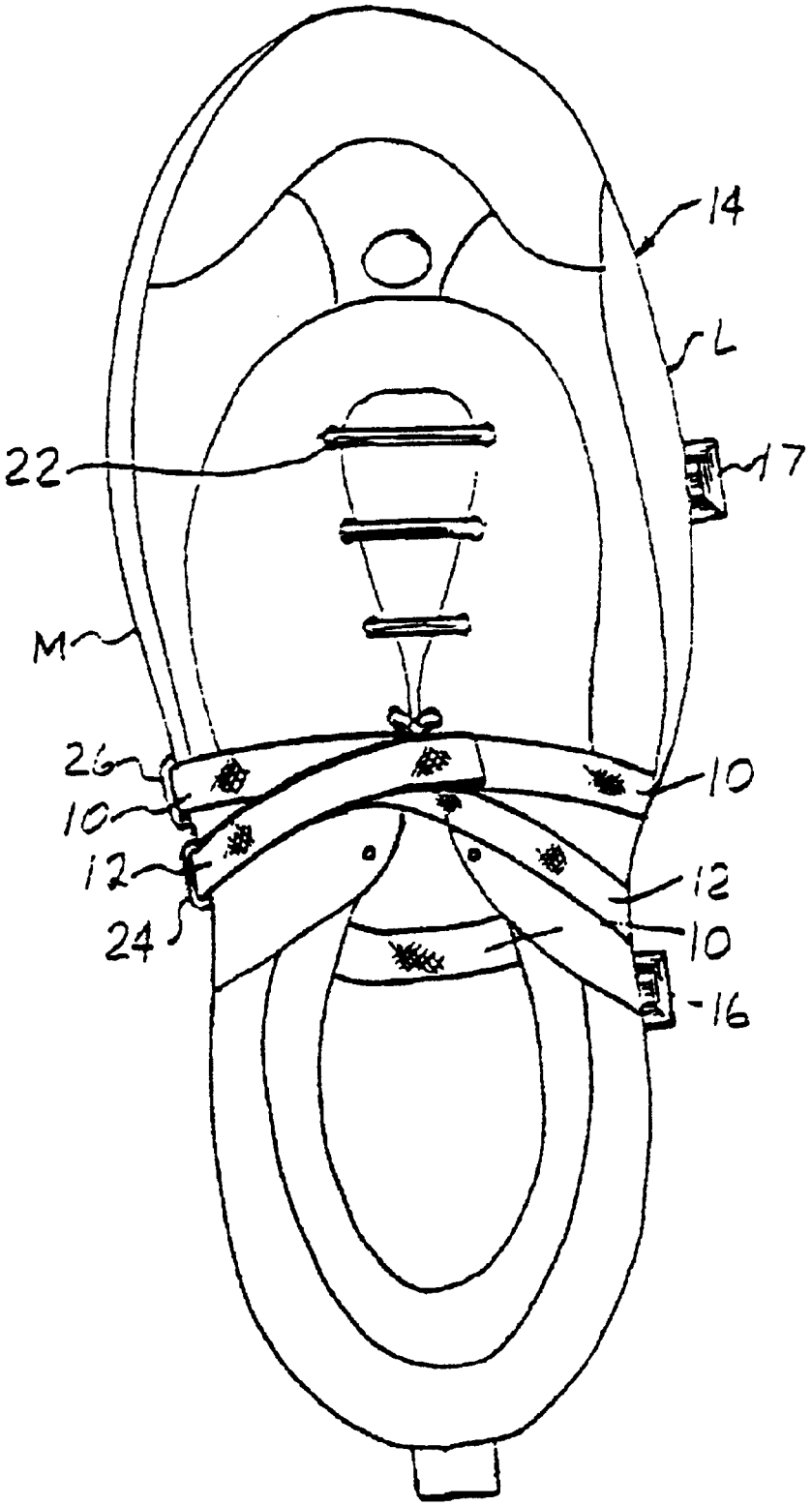
FIG. 5 is a plan view of an athletic shoe according to the present invention with the straps tied up (connected) and with the foot removed.

FIG. 5 shows an athletic shoe 14 according to the present invention with a foot removed and the straps 10 and 12 connected. The lateral bumper supports 16 and 17 can be manufactured into the lateral sole of the athletic shoe 14. As discussed hereinabove, the anterior lateral bumper support 17 is at the level of the head of the $5^{th}$ metatarsal and the more posterior lateral bumper support 16 is just proximal to the base of the $5^{th}$ metatarsal at the anterior heel.

After the athletic shoe 14 is laced, strap 10 is cinched moderately to tight, pulled through the anterior buckle 26 sewn on the medial outside shoe and secured back on itself by an attachment, such as a "VELCRO" attachment. Strap 10 (which could be made of "NYLON") is placed over approximately the third lace holes. Strap 12 (which also could be made of "NYLON") is shown to exit the athletic shoe 14 posteriorly to strap 10, is then cinched tightly and pulled over the level of the first and second laces 22, through a buckle 24 which is posterior to anterior buckle 26 and is also attached by Velcro over the strap 10 to complete the process.

Figure 6:
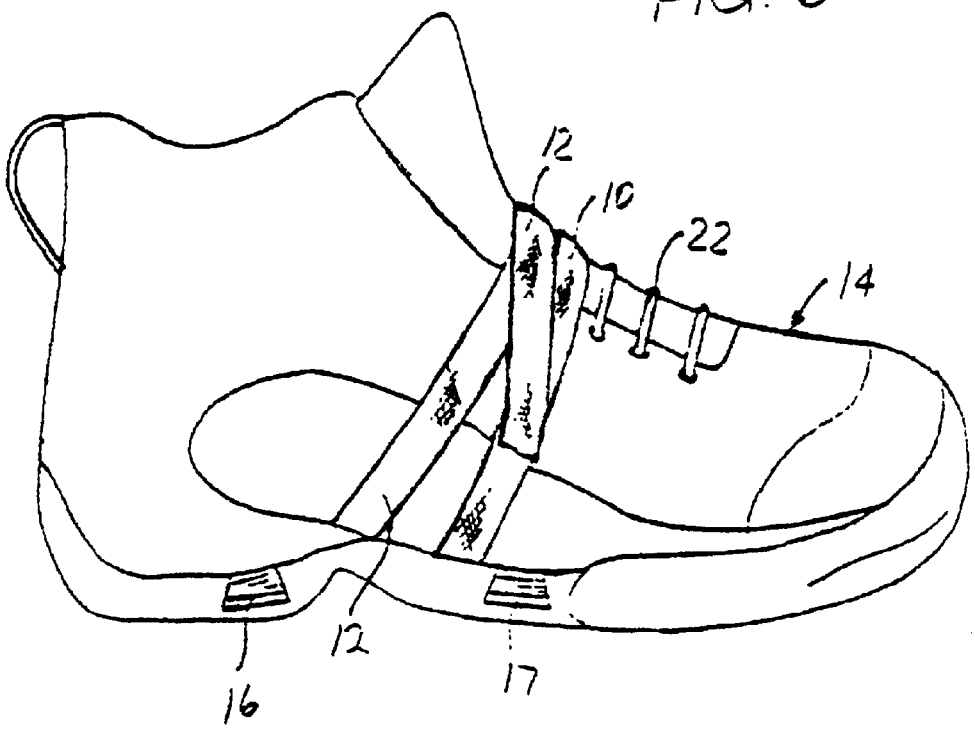
FIG. 6 is a perspective side view (outside view) of an athletic shoe according to the present invention, wherein the lateral side of the shoe is depicted.

FIG. 6 shows a lateral view of the athletic shoe 14 tied and secured, with the foot absent. FIG. 6 shows straps 10 and 12 exiting the lateral side slits just above the hard rubber sole 34, with the strap 10 more anterior than the strap 12. Portion 28 of strap 12 rests on strap 10. FIG. 6 also shows the strap 12 at its terminal portion secured by Velcro over strap 10 on the dorsum of the athletic shoe 14. The lateral bumper supports 16,17 are also shown. Lateral bumper supports 16,17 do not touch the ground when a person is standing erect. The wide bases of lateral bumper supports 16,17 will offer a greater surface area to contact the ground or uneven object if the ankle of the wearer of the shoe inverts.

Figure 7:
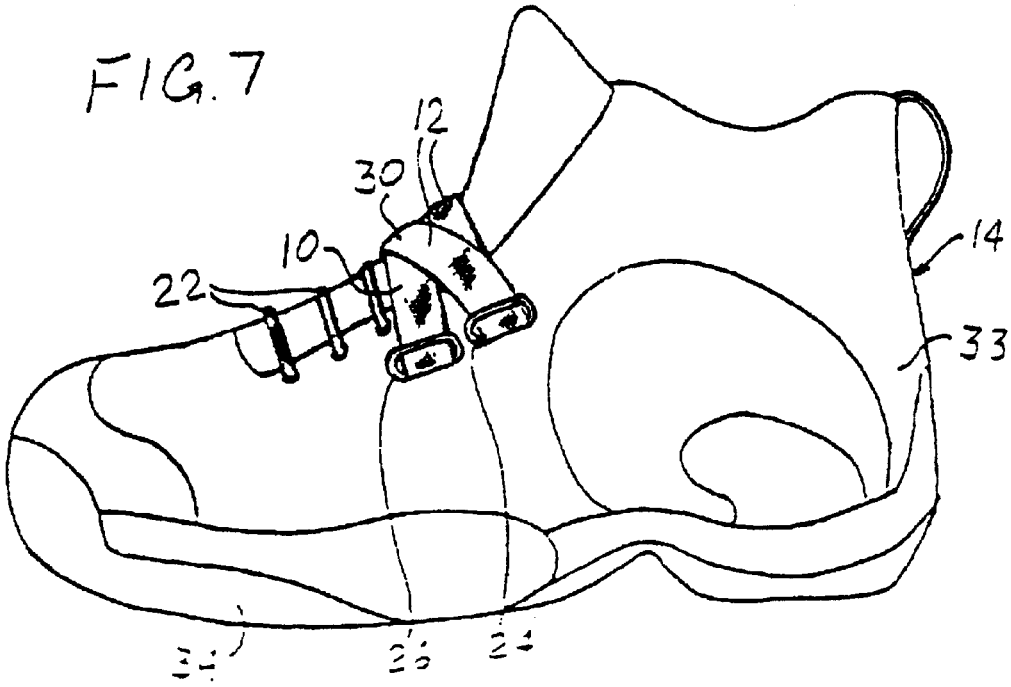
FIG. 7 is a perspective side view (inside view) of an athletic shoe according to the present invention, wherein the medial side of the shoe is depicted.

FIG. 7 depicts a medial view of the athletic shoe 14 showing the upper component 33 and the sole 34. FIG. 7 also shows the strap 10, which is anterior to strap 12, being pulled through the more anterior buckle 26 and then folded back on itself, secured with "VELCRO" and overlying approximately the third lace holes 22. The strap 12 is cinched through the posterior buckle 24 and secured anteriorly on top of the terminal portion 30 of the strap 10, and is again secured by "VELCRO".

Figure 8:
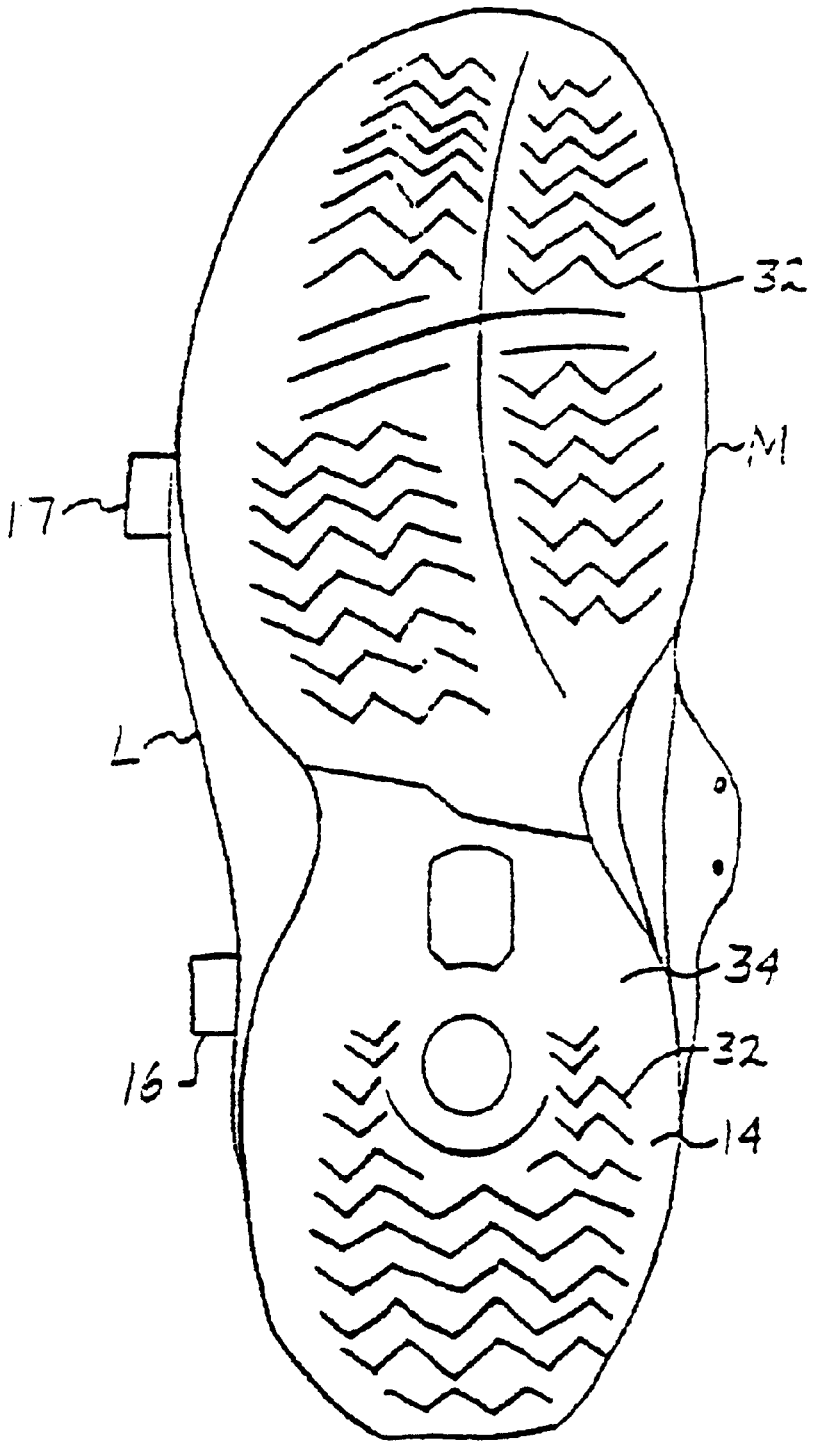
FIG. 8 is a bottom plan view showing the undersurface of an athletic shoe according to the present invention.

FIG. 8 shows the undersurface view of the shoe illustrating the treads 32 and the lateral bumper supports 16,17. The lateral bumper supports 16,17 are molded into the lateral rubber sole 34 and project out approximately ½ inch beyond the athletic shoe 14. This provides a broad base for landing, should the ankle of the wearer of the athletic shoe 14 be forced into an inverted position.

Figure 9:
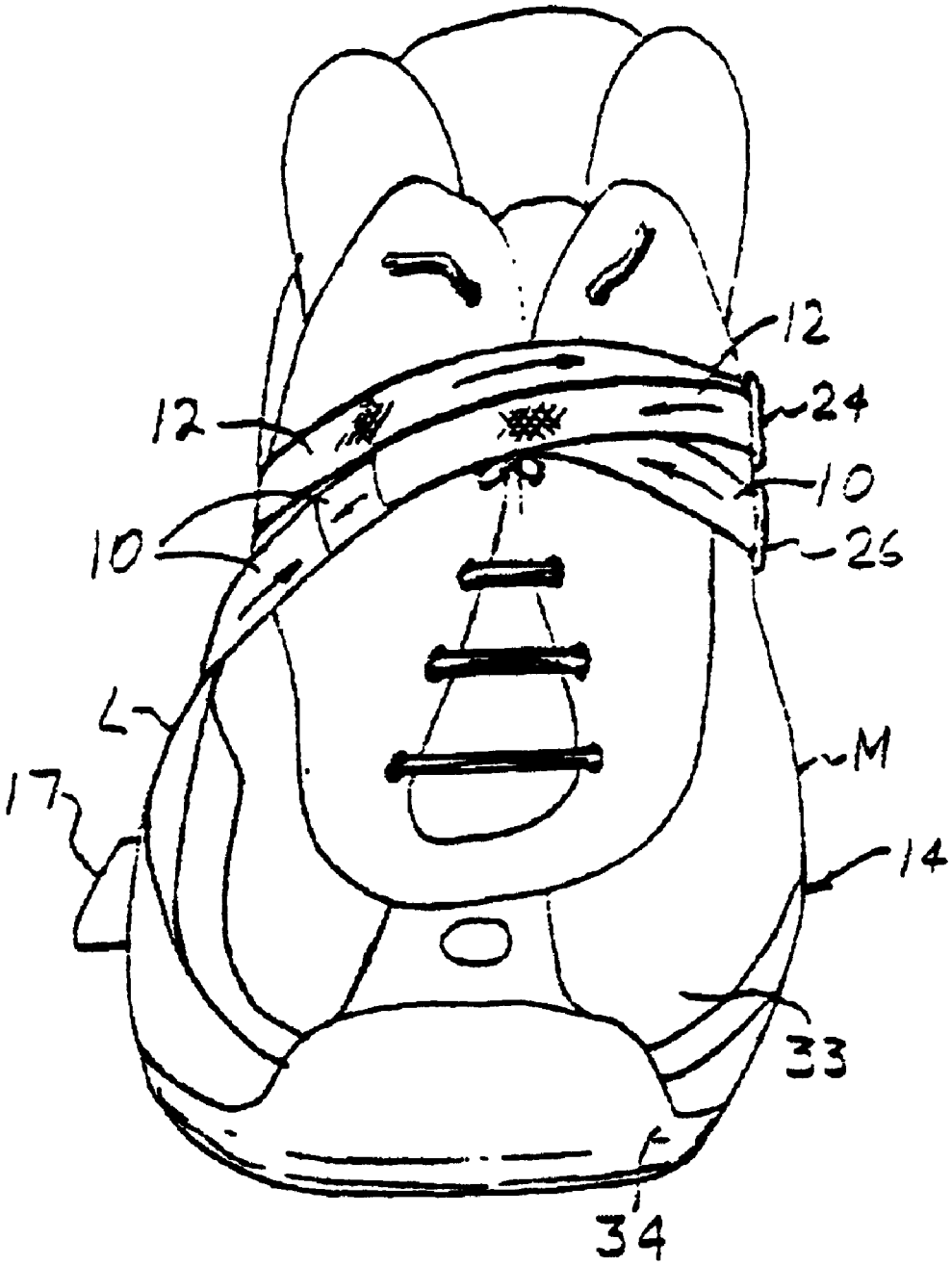
FIG. 9 is a front elevational view of an athletic shoe according to the present invention.
Figure 10:
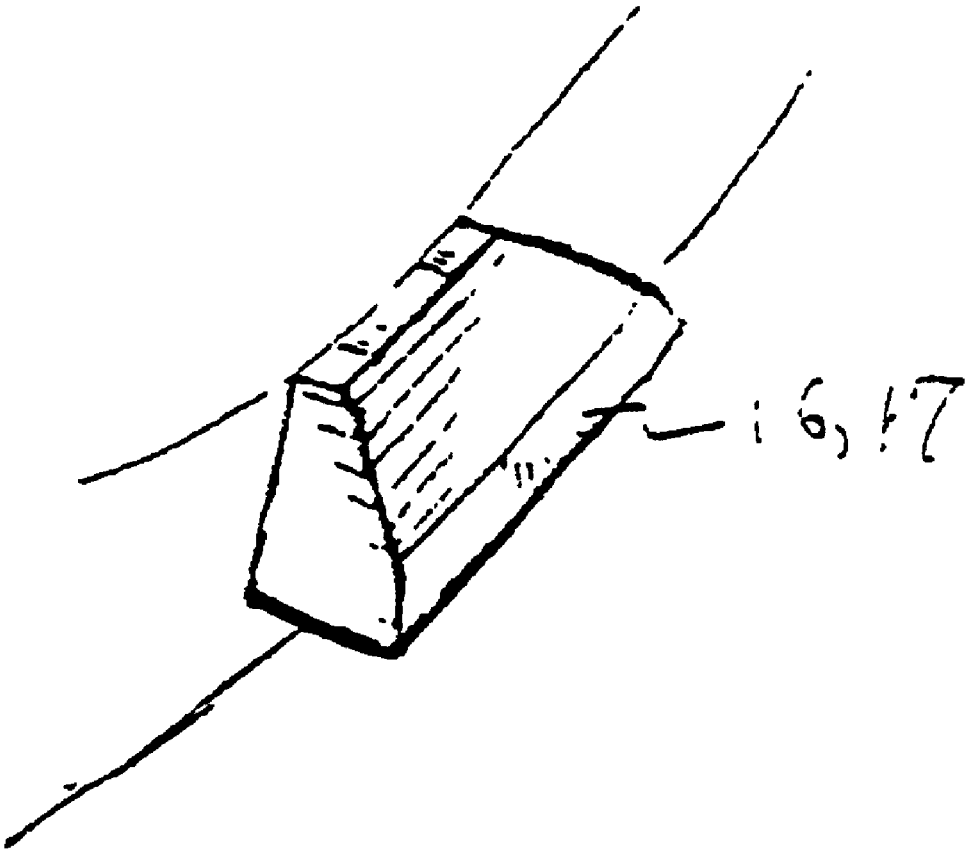
FIG. 10 is an enlarged perspective view of a lateral bumper support as shown in FIG. 3.

FIG. 9 depicts a frontal view of the athletic shoe 14 showing the strap 10 (which could be made of "NYLON") extending from the lateral side to the medial side across the region of the third laces 22, pulled through the buckle 26 medially and secured back over on top of itself. The strap 12 is shown also extending across the dorsum of the athletic shoe 14 from the lateral exit point to the medial buckle 24 and is cinched and secured on top of the strap 10. The strap 12 is pulled over the top of the first and/or second laces 22. The top laces 22 would be tied prior to securing the straps under ordinary circumstances, but have been left untied for illustrative purposes. Also depicted in FIG. 9 is the more anterior lateral bumper support 17.

The dimensions given hereinabove apply primarily to ¾ top basketball shoes and to athletes with average size ankles. The dimensions should be altered appropriately to athletes with ankles/feet significantly larger or smaller than the average. In addition, these concepts can be applied to athletic shoes in other sports in which ankle sprains are common, including but not limited to, soccer, track, cross country, tennis, baseball, football, and volleyball. It is considered that the athletic shoe of the present invention could become the prototype athletic shoe in all of the above mentioned sports. The major difference in the athletic shoe of the present invention when used for athletic sports other than basketball, however, is that the athletic shoes would be low cut. The lateral bumper supports may not be necessary because of the overall decreased incidence of ankle sprains in these sports compared to basketball. The other components of the present invention would be similar.

The athletic shoe may include a combination of the above-described embodiments, such as internal fixation straps+lateral bumper supports; internal fixation straps+enhancement of stiffness of sidewalls; internal fixation straps+lateral bumper supports+enhancement of stiffness of sidewalls.

It will be appreciated that the instant specification is set forth by way of illustration and not limitation, and that various modifications and changes may be made without departing from the spirit and scope of the present invention.

What is claimed is:

1. An athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, and a back portion between the medial sidewall and the lateral sidewall; and two elongate straps, one end of each of the two elongate straps being intimately secured to an inner surface of the shoe, the two elongate straps contact a foot within the shoe, the two elongate straps support the ankle mortise and support the lateral calcaneofibular and anterior talofibular ligaments of a foot within the shoe such that a first strap of the two elongate straps cross approximately perpendicular to the anterior talo-fibular ligament and a second strap of the two elongate straps extends approximately parallel to the calcaneofibular ligament and extend across the anterior talofibular ligament, the two elongate straps each having a free end which is detachably securable to each other and an outer surface of the shoe and being tightenable to reduce or prevent ankle inversion stresses of a foot within the shoe.

2. An athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, a back portion between the medial sidewall and the lateral sidewall; and two elongate straps, one end of each of the two elongate straps being intimately secured to an inner surface of the shoe, the two elongate straps capable of supporting the ankle mortise and lateral ligaments of a foot within the shoe, the two elongate straps each having a free end which is detachably securable to each other and an outer surface of the shoe and being tightenable to reduce or prevent ankle inversion stresses of a foot within the shoe, wherein the two elongate straps comprise a first elongate strap and a second elongate strap, the first elongate strap being secured at an end portion thereof at a junction of the sole and the medial sidewall, the first elongate strap extending inside the shoe across the upper surface of the sole in a region where the mid arch of a foot within the shoe would be located, and extending horizontally for disposition on the top of a foot within the shoe, the first elongate strap exiting the shoe through the lateral sidewall adjacent to the upper surface of the sole for extending across a top surface of the shoe and passing through a first fastening device disposed on an outer surface of the shoe and adjacent to the top of the medial sidewall, the first elongate strap having a first attachment component on a free end thereof; and the second elongate, strap being secured at an end portion thereof at the lateral sidewall of the shoe in a region where the level of the base of the $5^{th}$ metatarsal of a foot within the shoe would be located, the second elongate strap extending across the back portion of the shoe adjacent to the top of the upper component, and running parallel to the sole in the medial sidewall before exiting the medial sidewall, and extending horizontally within a tongue in an upper surface of the upper component, the second elongate strap extending across the ankle of a foot within the shoe, the second elongate strap exiting the shoe through the lateral sidewall adjacent to the upper surface of the sole and passing through a second fastening device disposed posterior to the first fastening device, the second elongate strap having a second attachment component on a free end thereof for engagement with the first attachment component of the first elongate strap.

3. An athletic shoe comprising:

a bottom component having a top surface and a bottom surface, the bottom component including a sole having an upper surface and a lower surface;

an upper component extending from the top surface of the bottom component for accommodating a foot therein, the upper component having a medial sidewall, a lateral sidewall, a back portion between the medial sidewall and the lateral sidewall; and two elongate straps, one end of each of the two elongate straps being intimately secured to an inner surface of the shoe, the two elongate straps capable of supporting the ankle mortise and lateral ligaments of a foot within the shoe, the two elongate straps each having a free end which is detachably securable to each other and an outer surface of the shoe and being tightenable to reduce or prevent ankle inversion stresses of a foot within the shoe, wherein the two elongate straps comprise a first elongate strap and a second elongate strap, the first elongate strap being secured at an end portion thereof at a junction of the sole and the medial sidewall, the first elongate strap extending inside the shoe across the upper surface of the sole in a region where the mid arch of a foot within the shoe would be located, and extending horizontally for disposition on the top of a foot within the shoe, the first elongate strap exiting the shoe through a first slit in the lateral sidewall adjacent to the upper surface of the sole, the first elongate strap then extending across the top of the shoe, passing through a first fastening device on an outer surface of the shoe and adjacent to the top of the medial sidewall, the first elongate strap having a first releasable attachment component being disposed on an inner surface thereof and adjacent to a free end of the first elongate strap; and the second elongate strap being secured within a channel in the lateral sidewall of the shoe in a region where the level of the base of the $5^{th}$ metatarsal of a foot within the shoe would be located, the second elongate strap extending across the back portion of the shoe adjacent to the top of the upper component, and running parallel to the sole in the medial sidewall before exiting the medial sidewall, and extending horizontally within a channel within a tongue in an upper surface of the upper component, the second elongate strap extending across an ankle of a foot within the shoe and exiting the shoe through a second slit on the lateral sidewall adjacent to the upper surface of the sole, the second elongate strap passing through a second fastening device disposed posterior to the first fastening device, the second elongate strap having a second releasable attachment component on an inner surface of a free end thereof for engagement with the first releasable attachment component of the first elongate strap.

4. The athletic shoe of claim 3, wherein the first releasable attachment component and the second releasable attachment component comprise a material which comprises complementary male and female forms which adhere to one another when pressed together and are separated by being pulled apart.

5. The athletic shoe of claim 3, wherein at least one of the first fastening device and the second fastening device is a buckle.

6. The athletic shoe of claim 3, wherein the first elongate strap is 1⅜ to 1⅝ inches wide.

7. The athletic shoe of claim 3, wherein the first elongate strap is 1½ inches wide.

8. The athletic shoe of claim 3, wherein the second elongate strap is 1¼ to 1½ inches wide and is 9 to 11 inches long.

9. The athletic shoe of claim 8, wherein the second elongate strap is made of a material selected from the group consisting of nylon, rubber and a latex material.

10. The athletic shoe of claim 3, further comprising at least two lateral support bumpers disposed integrally with the shoe and on an outer surface of the lateral sidewall, the lateral support bumpers being disposed adjacent to the sole above the bottom surface of the bottom component, and one of the lateral support bumpers being disposed in a region where the herd of the $5^{th}$ metatarsal of a foot within the shoe would be located, and a second of the lateral support bumpers being disposed adjacent to the anterior heel, the lateral support bumpers each having a base portion which projects laterally outward from the shoe at a distance of approximately ⅜ to ⅝ inches.

11. The athletic shoe of claim 3, wherein each of the medial sidewall and the lateral sidewall has a sufficiently stiff consistency to reduce or prevent acute angles that form during inversion stresses to a foot within the shoe.

12. The athletic shoe of claim 10, wherein each of the medial sidewall and the lateral sidewall has a sufficiently stiff consistency to reduce or prevent acute angles that form during inversion stresses to a foot within the shoe.

13. The athletic shoe of claim 1, further comprising at least two lateral support bumpers disposed integrally with the shoe and on an outer surface of the lateral sidewall, the lateral support bumpers being disposed adjacent to the sole above the bottom surface of the bottom component, and one of the lateral support bumpers being disposed in a region where the head of the $5^{th}$ metatarsal of a foot within the shoe would be located, and a second of the lateral support bumpers being disposed adjacent to the anterior heel, the lateral support bumpers each having a base portion which projects laterally outward from the shoe at a distance of approximately ⅜ to ⅝ inches.

14. The athletic shoe of claim 1, wherein each of the medial sidewall and the lateral sidewall has a sufficiently stiff consistency to reduce or prevent acute angles that form during inversion stresses to a foot within the shoe.

15. The athletic shoe of claim 13, wherein each of the medial sidewall and the lateral sidewall has a sufficiently stiff consistency to reduce or prevent acute angles that form during inversion stresses to a foot within the shoe.

16. The athletic shoe of claim 2, wherein at least one of the first fastening device and the second fastening device is a buckle.

17. The athletic shoe of claim 2, wherein the first elongate strap is 1⅜ to 1⅝ inches wide.

18. The athletic shoe of claim 2, wherein the first elongate strap is 1½ inches wide.

19. The athletic shoe of claim 2, wherein the second elongate strap is 1¼ to 1½ inches wide and is 9 to 11 inches long.

20. The athletic shoe of claim 19, wherein the second elongate strap is made of a material selected from the group consisting of nylon, rubber and a latex material.

21. The athletic shoe of claim 19, further comprising at least two lateral support bumpers disposed integrally with the shoe and on an outer surface of the lateral sidewall, the lateral support bumpers being disposed adjacent to the sole above the bottom surface of the bottom component, and one of the lateral support bumpers being disposed in a region where the herd of the $5^{th}$ metatarsal of a foot within the shoe would be located, and a second of the lateral support bumpers being disposed adjacent to the anterior heel, the lateral support bumpers each having a base portion which projects laterally outward from the shoe at a distance of approximately ⅜ to ⅝ inches.

22. The athletic shoe of claim 2, wherein each of the medial sidewall and the lateral sidewall has a sufficiently stiff consistency to reduce or prevent acute angles that form during inversion stresses to a foot within the shoe.

23. The athletic shoe of claim 21, wherein each of the medial sidewall and the lateral sidewall has a sufficiently stiff consistency to reduce or prevent acute angles that form during inversion stresses to a foot within the shoe.

* * * * *

UNITED STATES PATENT AND TRADEMARK OFFICE

CERTIFICATE OF CORRECTION

PATENT NO. : 6,775,929 B2
DATED : August 17, 2004
INVENTOR(S) : Barry H. Katz et al.

It is certified that error appears in the above-identified patent and that said Letters Patent is hereby corrected as shown below:

Title page,
Item [57], ABSTRACT,
Line 3, replace "projection" with -- protection --.

Column 8,
Line 67, replace "½" with -- 1½ --.

Column 15,
Line 2, replace "$1^{6}/_{8}$" with -- 1⅝ --.

Signed and Sealed this

Eighteenth Day of January, 2005

JON W. DUDAS
*Director of the United States Patent and Trademark Office*